US010645509B2

(12) United States Patent
Itano et al.

(10) Patent No.: US 10,645,509 B2
(45) Date of Patent: May 5, 2020

(54) LOUDSPEAKER DIAPHRAGM, METHOD OF MANUFACTURING SAME, AND LOUDSPEAKER EMPLOYING SAME

(71) Applicant: Panasonic Intellectual Property Management Co., Ltd., Osaka (JP)

(72) Inventors: Tetsushi Itano, Osaka (JP); Tomonori Shibuya, Osaka (JP); Mitsukazu Kuze, Osaka (JP); Yoshiyuki Takahashi, Okayama (JP); Ryo Kuribayashi, Osaka (JP); Hiroyuki Amada, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/264,796

(22) Filed: Feb. 1, 2019

(65) Prior Publication Data

US 2019/0166445 A1 May 30, 2019

Related U.S. Application Data

(63) Continuation of application No. PCT/JP2017/031292, filed on Aug. 31, 2017.

(30) Foreign Application Priority Data

Sep. 13, 2016 (JP) ..... 2016-178120

(51) Int. Cl.
*H04R 31/00* (2006.01)
*H04R 7/12* (2006.01)
(Continued)

(52) U.S. Cl.
CPC ..... *H04R 31/003* (2013.01); *H04R 7/122* (2013.01); *H04R 7/125* (2013.01); *H04R 9/025* (2013.01); *H04R 9/06* (2013.01); *H04R 2307/029* (2013.01)

(58) Field of Classification Search
CPC ..... H04R 7/122; H04R 7/125; H04R 9/025; H04R 9/026; H04R 31/003; H04R 2307/029
See application file for complete search history.

(56) References Cited

U.S. PATENT DOCUMENTS 5,966,797 A * 10/1999 Okazaki ..... H04R 7/16 29/527.1
6,039,146 A * 3/2000 Byun ..... H04R 31/003 181/169
2009/0045005 A1* 2/2009 Byon ..... H04R 7/02 181/167

FOREIGN PATENT DOCUMENTS

JP 2015-043548 3/2015

OTHER PUBLICATIONS

International Search Report of PCT application No. PCT/JP2017/031292 dated Nov. 21, 2017.

* cited by examiner

*Primary Examiner* — Brian Ensey
(74) *Attorney, Agent, or Firm* — Greenblum & Bernstein, P.L.C.

(57) ABSTRACT

A loudspeaker diaphragm includes a woven fabric which is a base member, a sealing layer, and a coating layer. The woven fabric includes a first face and a second face on the reverse side of the woven fabric from the first face. The woven fabric is made into the shape of a diaphragm. The sealing layer is disposed on the first face of the woven fabric, and seals the mesh openings surrounded by warp threads and
(Continued)

weft threads of the woven fabric. The coating layer is formed of a first composite material which is a mixture of a plurality of first short nanofibers and a first resin. The coating layer permeates the woven fabric from the second face of the woven fabric to the sealing layer.

10 Claims, 7 Drawing Sheets

(51) Int. Cl.
*H04R 9/02* (2006.01)
*H04R 9/06* (2006.01)

| | Comparative Example | Practical Example |
|---|---|---|
| Coating Layer | Absent | Present |
| Upper Limit Frequency (Fh) | 25 kHz | 40 kHz |
| Secondary Distortion(Fh) | ≤ 1 % | ≤ 0.3 % |
| Sound Pressure | 86 dB | 86 dB |

LOUDSPEAKER DIAPHRAGM, METHOD OF MANUFACTURING SAME, AND LOUDSPEAKER EMPLOYING SAME

CROSS-REFERENCE TO RELATED APPLICATIONS

This application is a continuation of the PCT International Application No. PCT/JP2017/031292 filed on Aug. 31, 2017, which claims the benefit of foreign priority of Japanese patent application No. 2016-178120 filed on Sep. 13, 2016, the contents all of which are incorporated herein by reference.

BACKGROUND

1. Technical Field

The present disclosure relates to a loudspeaker, a diaphragm included in the loudspeaker, and a method of manufacturing the diaphragm.

2. Description of the Related Art

Loudspeaker diaphragms are required to be lightweight and be unlikely to allow air to pass through. Japanese Patent Unexamined Publication No. 2015-43548 (hereinafter referred as PTL 1) discloses a diaphragm which includes: a woven fabric as a base member, microfibers as short fibers stacked on the woven fabric, and a coating layer. The microfiber short fibers are stacked on the woven fabric through a wet sheet-forming process to seal the texture (mesh openings) of the woven fabric. The coating layer covers the surfaces of the short fibers stacked on the woven fabric.

With this configuration, even in the case where a woven fabric, which is made of rigid fibers and has large mesh openings, is used as a base member, only the mesh openings of the surface of the woven fabric can be sealed by the short fibers. Accordingly, it is possible to manufacture a diaphragm which is unlikely to allow air to pass through and is lightweight.

SUMMARY

In order to stack short fibers on a woven fabric through a wet sheet-forming process, a sheet material solution, in which short fibers are mixed in water at a given concentration, is used. Subsequently, only water in the sheet material solution is effused through the mesh openings of the woven fabric, so that the short fibers remain in the woven fabric. Therefore, PTL 1 uses, as short fibers, microfibers having an average length of at least one times and at most ten times as long as the average mesh opening of the woven fabric, and having an average diameter of 1 μm to 100 μm. Therefore, the short fibers remain on the surface of the woven fabric during the wet sheet-forming process, so that the short fibers can be stacked on the woven fabric.

Moreover, in PTL 1, after the short fibers are stacked on the woven fabric, the surfaces of the short fibers stacked on the woven fabric are covered with the coating layer in order to more reliably seal the mesh openings of the woven fabric.

In order to enhance the high frequency characteristics of the loudspeaker, to improve the distortion characteristics by increasing rigidity, or to reduce the weight of the loudspeaker, the mesh openings of the woven fabric as the base member are required to be sealed by short, fibers having an average diameter of less than 1 μm.

The present disclosure provides a diaphragm having such a configuration that, when short fibers having an average diameter of less than 1 μm are stacked on a woven fabric as a base member, the short fibers are not effused through the mesh openings of the woven fabric.

A first diaphragm according to the present disclosure includes a woven fabric which is a base member, a sealing layer, and a coating layer. The woven fabric has a first face and a second face which is on a reverse side of the woven fabric from the first face, and has been formed into a shape of a loudspeaker diaphragm. The sealing layer is disposed on the first face of the woven fabric, and seals mesh openings surrounded by warp threads and weft threads of the woven fabric. The coating layer is formed of a first composite material which is a mixture of a plurality of first short nanofibers and a first resin. The coating layer permeates the woven fabric from the second face of the woven fabric to the sealing layer.

Note that the short nanofibers are short fibers having an average diameter of less than 1 μm.

A second diaphragm according to the present disclosure includes a woven fabric which is a base member, and a sealing layer. The woven fabric has a first face and a second face which is on a reverse side of the woven fabric from the first face, and has been formed into the shape of a loudspeaker diaphragm. The sealing layer is disposed on the first face of the woven fabric, and seals mesh openings surrounded by warp threads and weft threads of the woven fabric. The sealing layer is formed of a first composite material which is a mixture of the plurality of first short nanofibers and a first resin.

In a method of manufacturing the first diaphragm, the sealing layer is formed on the first face of the woven fabric so as to seal the mesh openings surrounded by the warp threads and the weft threads of the woven fabric. The woven fabric is a base member and the sealing layer is formed before or after the woven fabric is formed into the shape of a diaphragm. In the case where the sealing layer is formed before the woven fabric is formed into the shape of the diaphragm, the first composite material, which is a mixture of the plurality of first short nanofibers and the first resin, is first applied or sprayed onto the second face of the woven fabric, which is on the reverse side of the woven fabric from the first face, so that the first composite material permeates to the sealing layer. Subsequently, the woven fabric is formed into the shape of a diaphragm, and the first composite material is dried. Alternatively, after the woven fabric with the sealing layer is formed into the shape of a diaphragm, the first composite material is applied or sprayed onto the second face of the woven fabric so that the first composite material permeates to the sealing layer, and the first composite material is dried. On the other hand, in the case where the woven fabric has been formed into the shape of a diaphragm, the first composite material is applied or sprayed onto the second face of the woven fabric so that the first composite material permeates to the sealing layer, and the first composite material is dried.

In a method of manufacturing the second diaphragm, the sealing layer is formed on the first face of the woven fabric so as to seal the mesh openings surrounded by the warp threads and the weft threads of the woven fabric. The woven fabric is a base member, and the sealing layer is formed before or after the woven fabric is formed into the shape of a diaphragm. To form the sealing layer, a composite material, which is a mixture of a plurality of short nanofibers and a resin, is applied or sprayed onto the first face of the woven fabric. Subsequently, in the case where the sealing layer is formed before the woven fabric is formed into the shape of a diaphragm, the woven fabric with the sealing layer is formed into the shape of a diaphragm.

Moreover, a loudspeaker according to the present disclosure includes a magnetic circuit, one of the diaphragms described above, a bobbin, and a voice coil. The magnetic circuit is provided with a magnetic gap. The bobbin has a first end coupled to the diaphragm and a second end disposed in the magnetic gap. The voice coil is wound around the bobbin, and is disposed in the magnetic gap.

In such configurations, the short nanofibers in the sealing layer or the coating layer permeate the woven fabric which is a base member. Accordingly, due to the short nanofibers, the rigidity and the strength of the base member can be increased, upper limit frequency characteristics of the loudspeaker can be extended, and the distortion can be reduced.

DETAILED DESCRIPTION OF PREFERRED EMBODIMENTS

Hereinafter, each embodiment of the present disclosure will be described with reference to the drawings.

First Exemplary Embodiment

Figure 1:
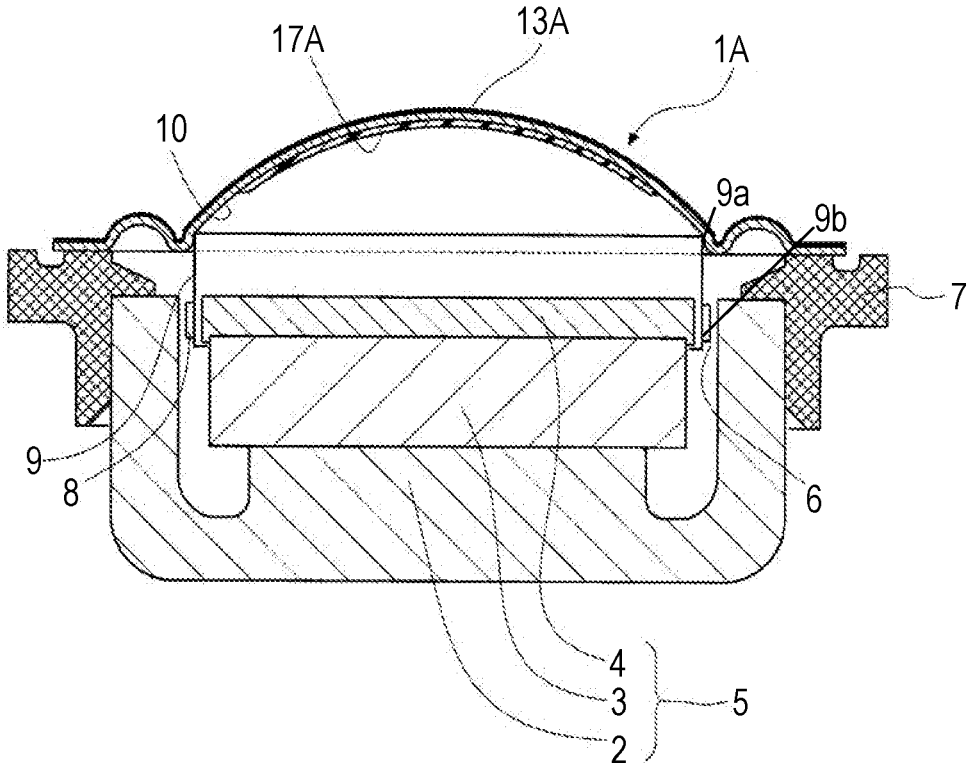
FIG. 1 is a cross-sectional view of a tweeter which includes a diaphragm according to a first exemplary embodiment of the present disclosure.

FIG. 1 is a cross-sectional view of a tweeter which includes a diaphragm according to the present embodiment.

The loudspeaker includes soft dome diaphragm 1A, magnetic circuit 5, frame 7, voice coil 8, and bobbin 9. Diaphragm 1A is manufactured by forming a woven fabric into the shape of a diaphragm. In the woven fabric, warp threads and weft threads linearly intersect with each other at a predetermined angle. Magnetic circuit 5 includes yoke 2, magnet 3, and plate 4. Magnetic gap 6 is disposed between yoke 2 and plate 4. Frame 7 is attached to yoke 2 near magnetic gap 6, and supports the outer periphery of diaphragm 1A. Bobbin 9 has first end 9*a* attached to the reverse face of diaphragm 1A, and second end 9*b* around which voice coil 8 is wound. Second end 9*b* is disposed in magnetic gap 6.

Figure 2A:
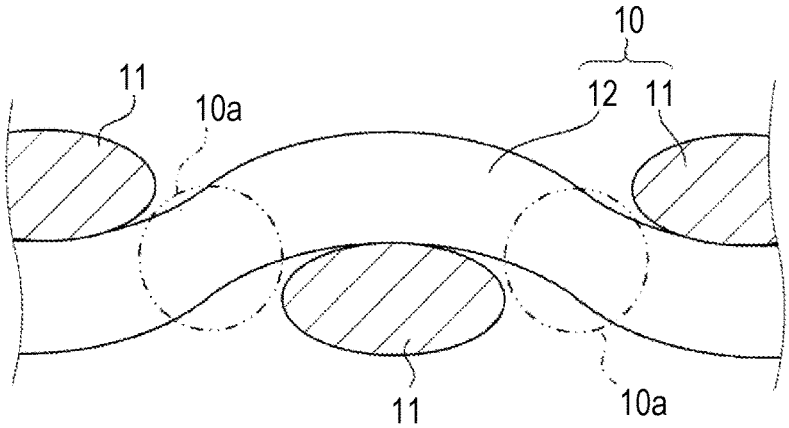
FIG. 2A is an enlarged cross-sectional view of the diaphragm illustrated in FIG. 1 in a manufacturing process.
Figure 2B:
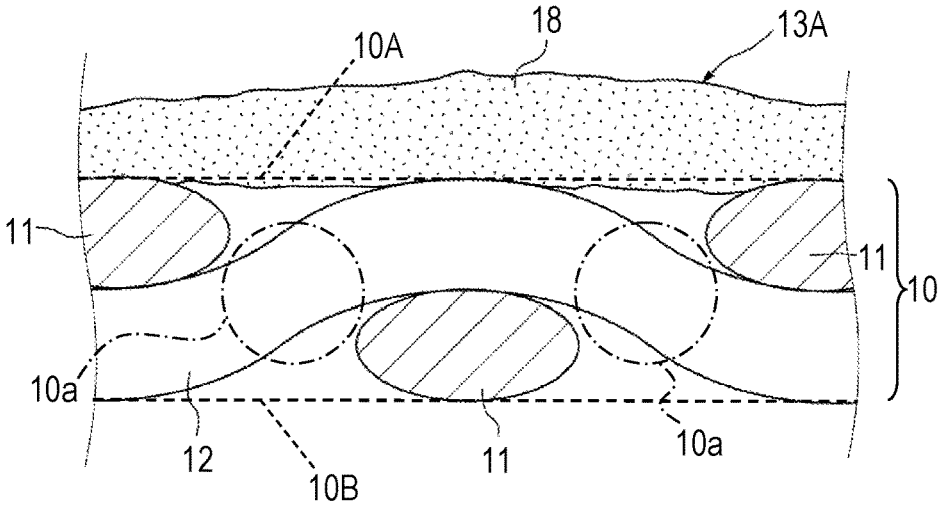
FIG. 2B is an enlarged cross-sectional view of the diaphragm in a manufacturing process subsequent to FIG. 2A.
Figure 2C:
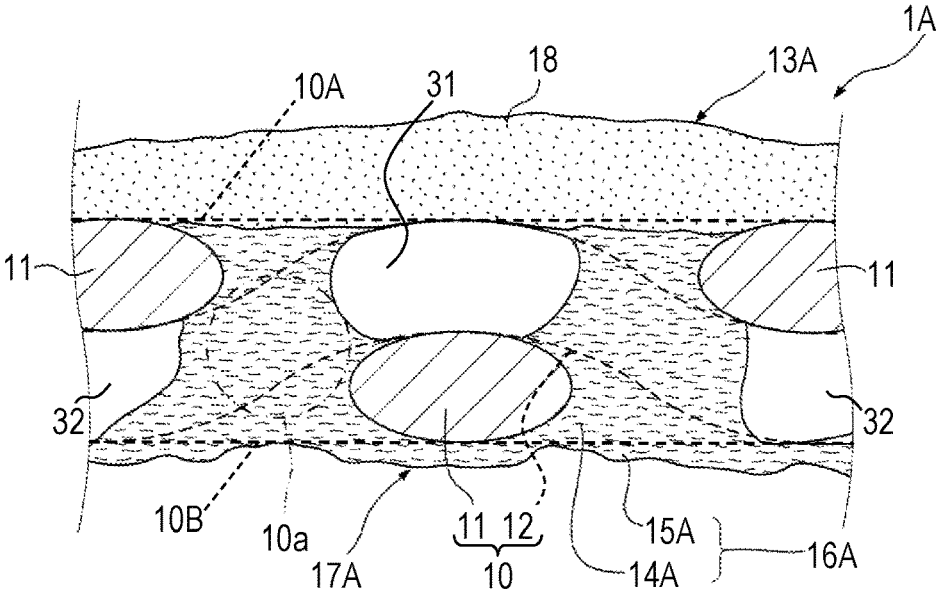
FIG. 2C is an enlarged cross-sectional view of the diaphragm illustrated in FIG. 1.

FIG. 2C is an enlarged cross-sectional view of diaphragm 1A. Sealing layer 13A is disposed on first face 10A of woven fabric 10 in which warp threads 11 and weft threads 12 intersect with each other. Sealing layer 13A seals mesh openings 10*a* surrounded by warp threads 11 and weft threads 12. Coating layer 17A permeates woven fabric 10 from second face 10B of woven fabric 10 to sealing layer 13A. Coating layer 17A is formed of first composite material 16A which is a mixture of short nanofibers 14A and resin 15A.

Note that nanofibers are fibrous substances each having a diameter of at least 1 nm and less than 1000 nm and a length which is at least 100 times as long as the diameter. Accordingly, the length of each of short nanofibers 14A is at least 0.1 μm and less than 100 μm. In contrast, the size of each mesh opening 10*a* is generally from 50 μm to 100 μm. Since nanofibers are not linearly extended, short nanofibers 14A can sufficiently remain in mesh openings 10*a*.

For example, air layer 31 is disposed between the top part of warp thread 11 and sealing layer 13A, next to weft thread 12. There are cases where air layer 31 is formed, and cases where air layer 31 is not formed due to the permeation of sealing layer 13A and first composite material 16A. Moreover, air layer 32 is disposed between the bottom of warp thread 11 and first composite material 16A, next to weft thread 12. In a similar manner, there are cases where air layer 32 is formed and cases where air layer 32 is not formed due to the permeation of first composite material 16A.

Next, manufacturing processes of diaphragm 1A will be described with reference to FIG. 2A to FIG. 2C. FIG. 2A and FIG. 2B are enlarged cross-sectional views of diaphragm 1A in respective manufacturing processes.

FIG. 2A shows an enlarged cross-sectional view of woven fabric 10. Warp threads 11 and weft threads 12 of woven fabric 10 are, for example, polyester fibers. The thickness of woven fabric 10 is, for example, 0.17 mm. Note that woven fabric 10 to be used for manufacturing diaphragm 1A here has a long belt shape which is before being formed into the shape of a dome diaphragm.

In the first step, as illustrated in FIG. 2B, impregnating agent 18 is applied or sprayed onto first face 10A of woven fabric 10 so that impregnating agent 18 permeates mesh openings 10*a*. Impregnating agent 18 is, for example, a mixture of phenolic resin and urethane resin. Woven fabric 10 in this state is thermoformed into the shape of a dome diaphragm at 190° C. to form sealing layer 13A. It is possible to form sealing layer 13A having an appropriate thickness by adjusting the viscosity and the supply amount of impregnating agent 18, and the relative movement speed of woven fabric 10 when impregnating agent 18 is evenly applied by a roll, by a brush or sprayed.

In the second step, first composite material 16A is applied or sprayed onto second face 10B of woven fabric 10, illustrated in FIG. 2B, formed into the shape of a diaphragm. First composite material 16A is, for example, a mixture of urethane resin as resin 15A and short nanofibers 14A. Short nanofibers 14A are made by micronizing bamboo pulp, for example, and have an average diameter of less than 1 μm.

Woven fabric 10 in this state is thermally dried at 120° C. to form coating layer 17A derived from first composite material 16A. The thickness of coating layer 17A is, for example, approximately 10 μm.

Note that the urethane resin included in first composite material 16A is an emulsion which includes solid content of approximately 30% and a hydrophilic solvent (dispersion medium) such as mostly water or ethanol. The state of short nanofibers 14A used for preparing first composite material 16A is a paste and the paste includes solid content of 8% to 10% and water as a dispersion medium. The weight ratio of the urethane resin (resin 15A) with respect to short nanofibers 14A in coating layer 17A, which has been formed on woven fabric 10 and from which the solvent has been volatized, is, for example, approximately, urethane resin/short nanofibers=8/2.

In this configuration, sealing layer 13A prevents short nanofibers 14A from being effused through first face 10A of woven fabric 10 to the outside, even when the average diameter of short nanofibers 14A of first composite material 16A applied or sprayed is less than 1 μm. Accordingly, it is possible to keep short nanofibers 14A within woven fabric 10.

Figures 3, 4:
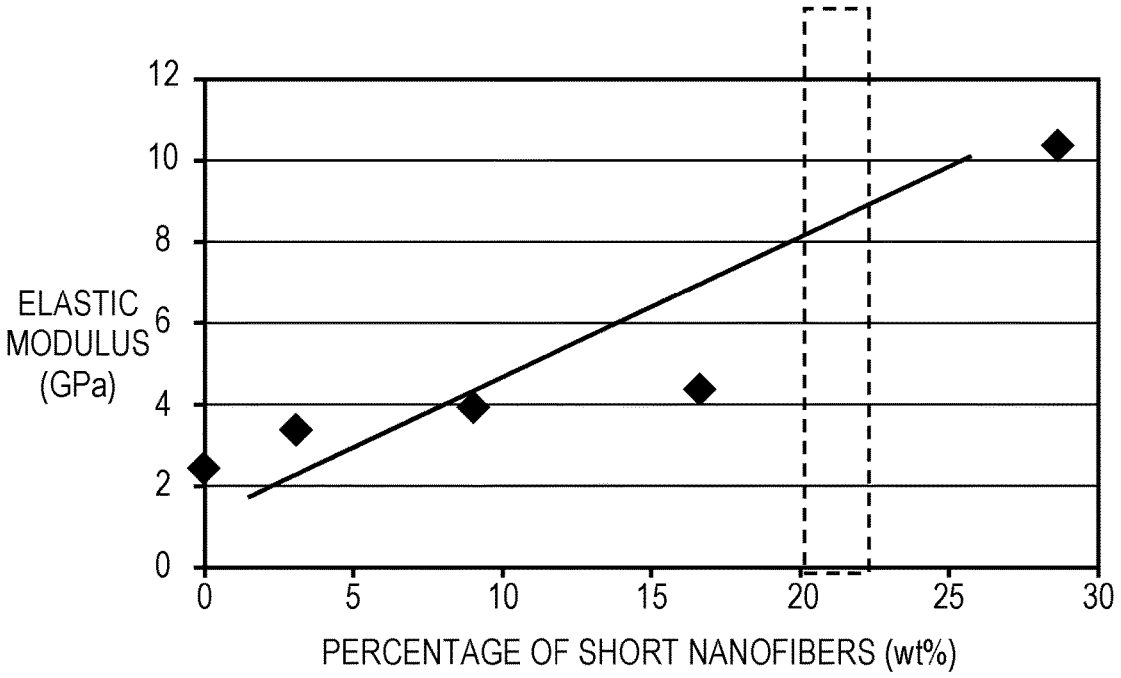
FIG. 3 illustrates a relationship between the percentage of nanofibers and the elastic modulus of the diaphragm.
FIG. 4 illustrates measurement results of a practical example and a comparative example.

In this way, diaphragm 1A can be reinforced appropriately by the elasticity of the short nanofibers. FIG. 3 illustrates experimental results of changes in elastic modulus of diaphragm 1A relative to the weight percentage of the short nanofibers in coating layer 17A. In the range, indicated by the dashed lines, where the percentage of the short nanofibers is 21% to 23%, proper elasticity is obtained. Although the elastic modulus of diaphragm 1A increases as the percentage of the short nanofibers increases, the viscosity of first composite material 16A increases, which leads to low workability.

Figure 5:
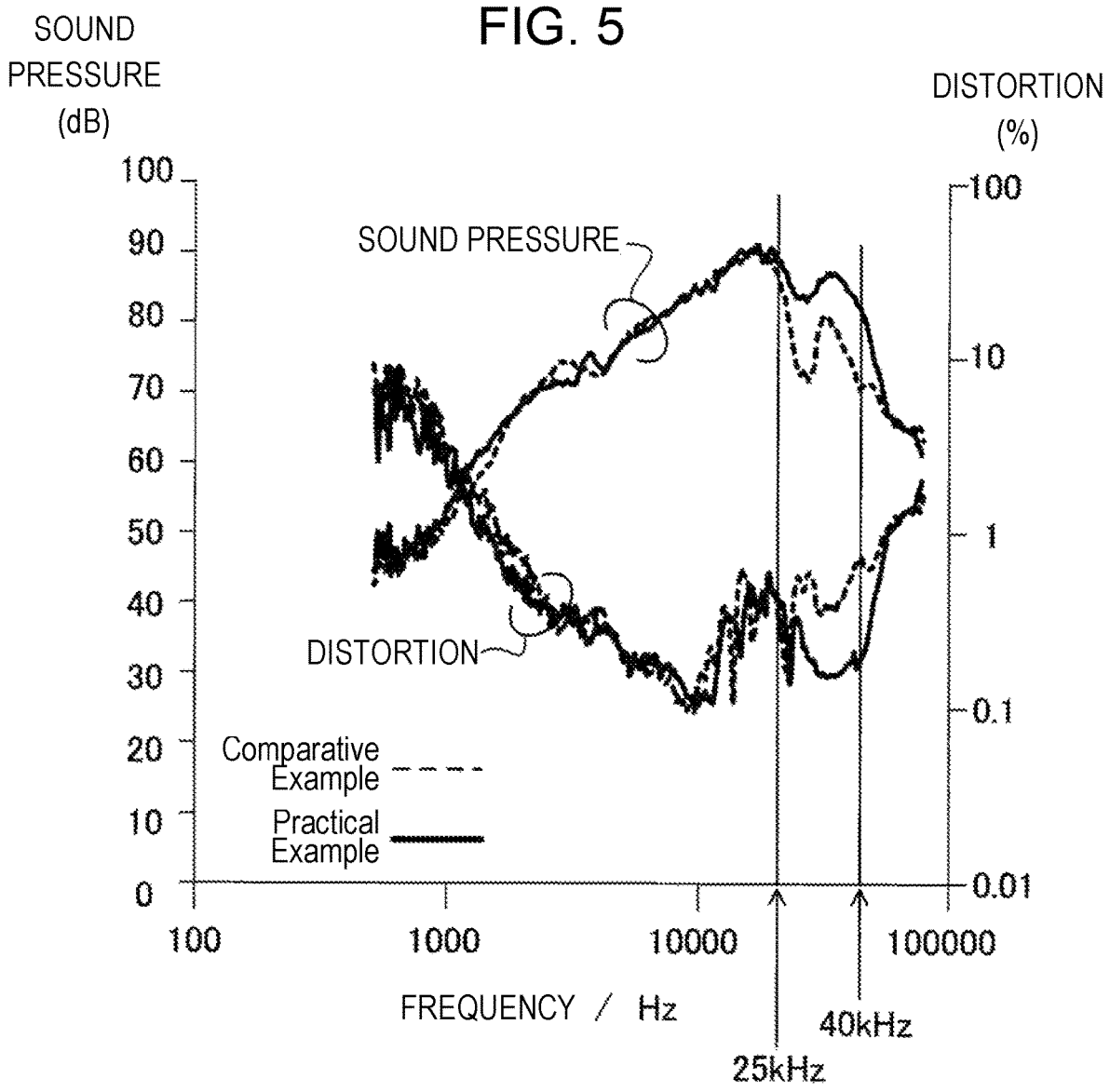
FIG. 5 is a frequency characteristic diagram of the loudspeaker diaphragms.

FIG. 4 shows a frequency characteristic diagram of the sound pressure and the distortion of a tweeter as a practical example of the present embodiment which includes diaphragm 1A with coating layer 17A, and a tweeter of a comparative example. FIG. 5 illustrates the comparison results of the frequency characteristics of the sound pressure. In the tweeter of the comparative example, a soft dome diaphragm which is the same as diaphragm 1A is used except that sealing layer 13A and coating layer 17A are absent.

Due to coating layer 17A, the rigidity and the strength of diaphragm 1A of the practical example are greater than those of woven fabric 10 which is a base member, Therefore, as understood from FIG. 4, the tweeter of the practical example has extended upper limit frequency characteristics of the loudspeaker, less distortion of the sound while maintaining the sound pressure characteristics, and thus higher sound quality, compared with the tweeter of the comparative example. Moreover, as illustrated in FIG. 5, the sound pressure is higher and the distortion is less in the high-frequency range of 25 kHz or higher in the practical example than in the comparative example.

In the above embodiment, a mixture of phenolic resin and urethane resin is used in order to form sealing layer 13A, however, any one of thermosetting resin and thermoplastic resin can be used for resin.

In the above embodiment, water-soluble urethane resin is used for preparing coating layer 17A, however, any liquid coating agent in which short nanofibers are dispersed can be used. Since the short nanofibers are hydrophilic, the resin included in the first composite material is also preferably resin or elastomer which can be dispersed in water. Specific examples of the resin contained in the first composite material include polyester resin, olefin resin, acrylic resin, polyamide resin, and latex.

Although it has been described that the micronized bamboo pulp is used as short nanofibers 14A, for example, chitin nanofibers made from crab shells or the like and synthetic nanofibers can also be used.

In the above embodiment, sealing layer 13A is formed before woven fabric 10 is formed into the shape of a diaphragm, however, sealing layer 13A may be formed after woven fabric 10 is formed into the shape of a diaphragm.

In the above embodiment, coating layer 17A is formed on woven fabric 10 having sealing layer 13A and having been formed into the shape of a diaphragm, however, woven fabric 10 may be formed into the shape of a diaphragm after sealing layer 13A and coating layer 17A are formed on woven fabric 10.

It has been described that the weight ratio of the urethane resin with respect to the short nanofibers in coating layer 17A is, for example, approximately, urethane resin/short nanofibers=8/2. However, the weight ratio of the resin with respect to the short nanofibers is not, limited to such an example. For example, the sound quality can be improved when the relation of 6/4≤urethane resin/short nanofibers≤9/1 is satisfied. In particular, when the relation of 7/3≤urethane resin/short nanofibers is satisfied, the sound quality can be significantly improved.

Second Exemplary Embodiment

In the first exemplary embodiment, only coating layer 17A disposed on second face 10B of woven fabric 10 includes short nanofibers 14A. In contrast, in the second exemplary embodiment, both the sealing layer and the coating layer include short nanofibers.

Figure 6A:
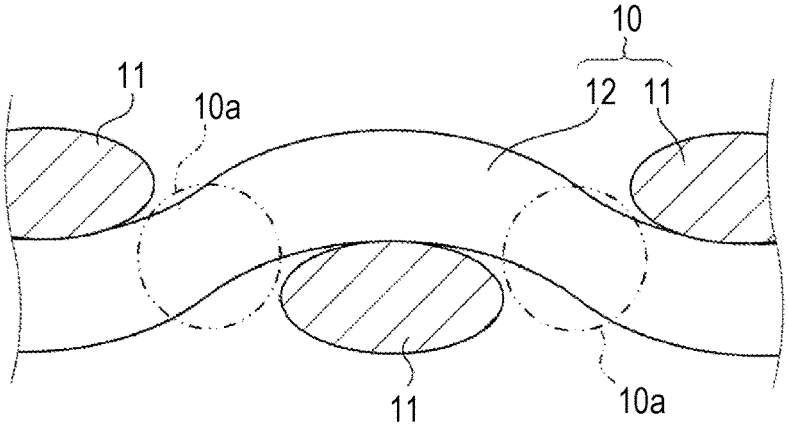
FIG. 6A is an enlarged cross-sectional view of a diaphragm according to a second exemplary embodiment of the present disclosure in a manufacturing process.
Figure 6B:
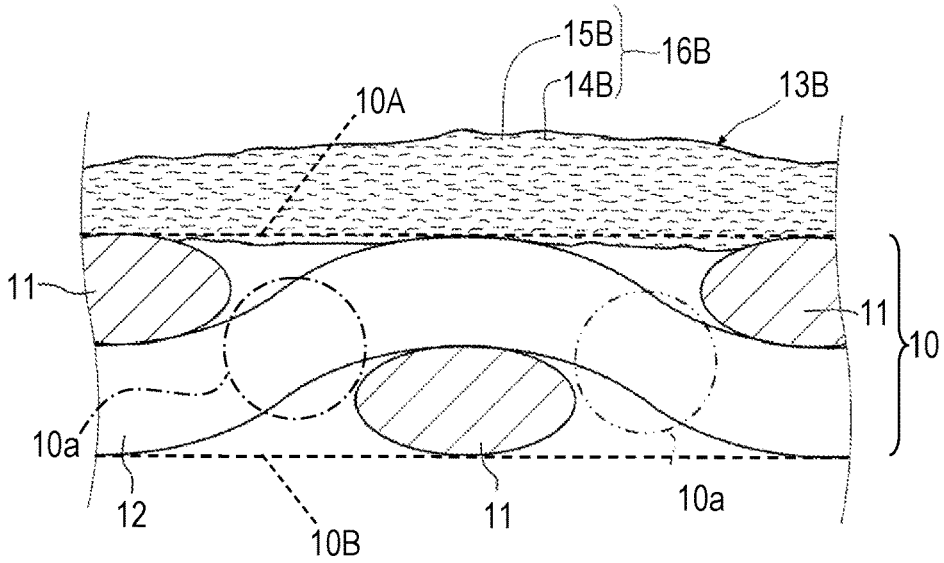
FIG. 6B is an enlarged cross-sectional view of the diaphragm in a manufacturing process subsequent to FIG. 6A.
Figure 6C:
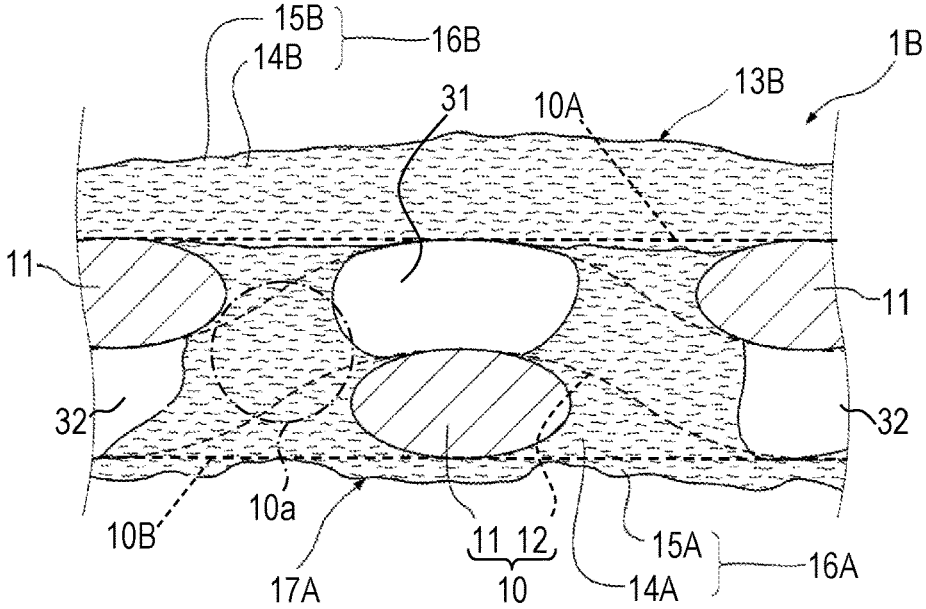
FIG. 6C is an enlarged cross-sectional view of the diaphragm according to the second exemplary embodiment of the present disclosure.

FIG. 6C illustrates an enlarged cross-sectional view of diaphragm 1B according to the present embodiment. Sealing layer 13B is disposed on first face 10A of woven fabric 10 in which warp threads 11 and weft threads 12 intersect with each other. Sealing layer 13B seals mesh openings 10*a* surrounded by warp threads 11 and weft threads 12. Sealing layer 13B is formed of second composite material 16B which is a mixture of short nanofibers 14B and resin 15B. Moreover, coating layer 17A permeates woven fabric 10 from second face 10B of woven fabric 10 to sealing layer 13B. The configuration of coating layer 17A is the same as that in the first exemplary embodiment.

Next, manufacturing processes of diaphragm 1B will be described with reference to FIG. 6A to FIG. 6C. FIG. 6A and FIG. 6B are enlarged cross-sectional views of diaphragm 1B in respective manufacturing processes.

FIG. 6A is an enlarged cross-sectional view of woven fabric 10. Warp threads 11 and weft threads 12 of woven fabric 10 are, for example, polyester fibers. The thickness of woven fabric 10 is, for example, 0.17 mm. Note that woven fabric 10 to be used in manufacturing diaphragm 1B here has a long belt shape which is before being formed into the shape of a dome diaphragm. In other words, woven fabric 10 is the same as that of the first exemplary embodiment.

In the first step, as illustrated in FIG. 6B, second composite material 16B is applied or sprayed onto first face 10A of woven fabric 10, so that second composite material 16B permeates mesh openings 10*a*. Woven fabric 10 in this state is thermoformed into a dome shape at 190° C. to form sealing layer 13B.

Second composite material 16B is a mixture of short nanofibers 14B, phenolic resin, and urethane resin. Second composite material 16B includes solid content of approximately 30%, and a hydrophilic solvent (dispersion medium) such as mostly water or ethanol.

Short nanofibers 14B are, for example, made by micronizing bamboo pulp, and have an average diameter of less than 1 μm. The state of short nanofibers 14B used for preparing second composite material 16B is a paste, and the paste includes solid content of 8% to 10% and water as a dispersion medium. The weight ratio of resin 15B, which is a mixture of phenolic resin and urethane resin, with respect to short nanofibers 14B in sealing layer 13B, which has been formed on woven fabric 10 and from which the solvent has been evaporated, is, for example, approximately, resin/short nanofibers=8/2. However, in a similar manner to coating layer 17A, the weight ratio of resin 15B with respect to short nanofibers 14B in sealing layer 13B is not limited to such an example. For example, the sound quality can be improved when the relation of 6/4≤resin/short nanofibers≤9/1 is satisfied.

Note that part of short nanofibers 14B may be effused through mesh openings 10*a* which are in the process of being sealed, but part or all of short nanofibers 14B remains in woven fabric 10 by adjustment of the viscosity of resin 15B.

It is possible to form sealing layer 13B having an appropriate thickness by adjusting the viscosity and the supply amount of second composite material 16B, and the relative movement speed of woven fabric 10 when second composite material 16B is evenly applied by a roll, by a brush, or sprayed.

In the second step, first composite material 16A is applied or sprayed on second face 10B of woven fabric 10, illustrated in FIG. 6B, which has been formed into the shape of a diaphragm. In a similar manner to the first exemplary embodiment, first composite material 16A illustrated in FIG. 6C is a mixture of, for example, urethane resin as resin 15A and short nanofibers 14A. Short nanofibers 14A are, for example, made by micronizing bamboo pulp, and have an average diameter of less than 1 μm. Hereinafter, coating layer 17A is formed in a similar manner to the first exemplary embodiment.

In this configuration as well, sealing layer 13B prevents short nanofibers 14A from being effused through first face 10A of woven fabric 10 to the outside, even when the average diameter of short nanofibers 14A in first composite material 16A applied or sprayed is less than 1 μm. Accordingly, it is possible to keep short nanofibers 14A within woven fabric 10.

In the tweeter which includes diaphragm 1B, due to sealing layer 13B and coating layer 17A, the rigidity and the strength of diaphragm 1B are greater than those of woven fabric 10 which is a base member. Accordingly, the tweeter which includes diaphragm 1B has extended upper limit frequency characteristics of the loudspeaker, less distortion while maintaining the sound pressure characteristics, and higher sound quality, compared with the tweeter which includes a diaphragm with no sealing layer 13B and no coating layer 17A.

Moreover, the attachment strength of coating layer 17A to woven fabric 10 is expected to increase by the engagement of part of short nanofibers 14B in sealing layer 13B with part of short nanofibers 14A in coating layer 17A.

In the present embodiment, a mixture of phenolic resin and urethane resin is used in order to form sealing layer 13B, however, any one of thermosetting resin and thermoplastic resin can be used for resin. However, in selecting resin to be mixed, it is desirable to consider the elastic modulus, the shape retention, formability, and wettability to short nanofibers 14B and woven fabric 10 after the curing.

Moreover, the percentage of resin in sealing layer 13B is not particularly limited. Moreover, instead of the mixture of resin, one kind of resin may be used as resin 15B. This also applies to sealing layer 13A according to the first exemplary embodiment, and to sealing layer 13B according to a third exemplary embodiment to be described later.

Although it has been described that the micronized bamboo pulp is used as short nanofibers 14A and 14B, for example, chitin nanofibers made from crab shells or the like or synthetic nanofibers may also be used.

Although it has been described that the material of short nanofibers 14A is the same as the material of short nanofibers 14B, but the materials may be different. Specifically, for example, one of the materials may be bamboo nanofibers and the other one may be chitin nanofibers. Moreover, the length and the average diameter of short nanofibers 14A may be the same as or different from the length and the average diameter of short nanofibers 14B.

It has been described that sealing layer 13B is formed before woven fabric 10 is formed into the shape of a diaphragm, but it may be that sealing layer 13B is formed after woven fabric 10 is formed into the shape of a diaphragm.

In the above embodiment, coating layer 17A is formed on woven fabric 10 having sealing layer 13B and having been formed into the shape of a diaphragm. However, woven fabric 10 may be formed into the shape of a diaphragm after sealing layer 13B and coating layer 17A are formed on woven fabric 10.

As described above, diaphragm 1B according to the present embodiment includes woven fabric 10 as a base member, sealing layer 13B, and coating layer 17A. Coating layer 17A is formed of first composite material 16A which is a mixture of short nanofibers 14A as a plurality of first short nanofibers and resin 15A as a first resin. Sealing layer 13B is formed of second composite material 16B which is a mixture of short nanofibers 14B as a plurality of second short nanofibers and resin 15B as a second resin. Sealing layer 13B is disposed on first face 10A of woven fabric 10 so as to seal mesh openings 10*a*. Coating layer 17A permeates woven fabric 10 from second face 10B of woven fabric 10 to sealing layer 13B.

Third Exemplary Embodiment

In the first exemplary embodiment, sealing layer 13A is disposed on first face 10A of woven fabric 10, coating layer 17A is disposed on second face 10B of woven fabric 10, and coating layer 17A includes short nanofibers 14A. In contrast, in the present embodiment, a sealing layer includes short nanofibers, and no coating layer 17A is included.

Figure 7A:
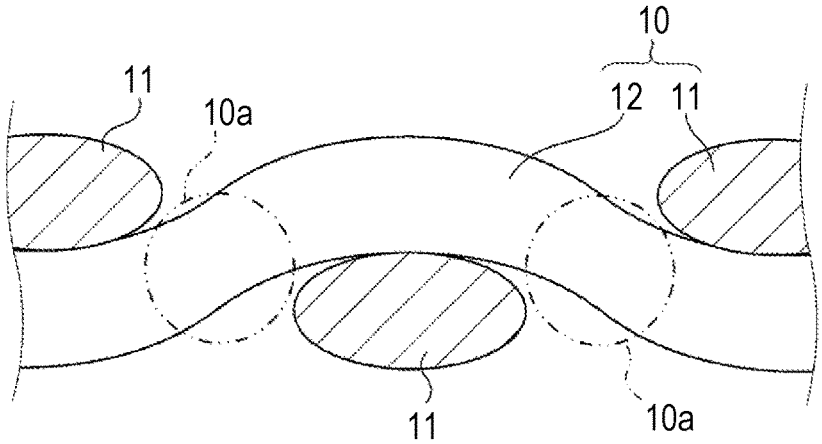
FIG. 7A is an enlarged cross-sectional view of a diaphragm according to a third exemplary embodiment of the present disclosure in a manufacturing process.
Figure 7B:
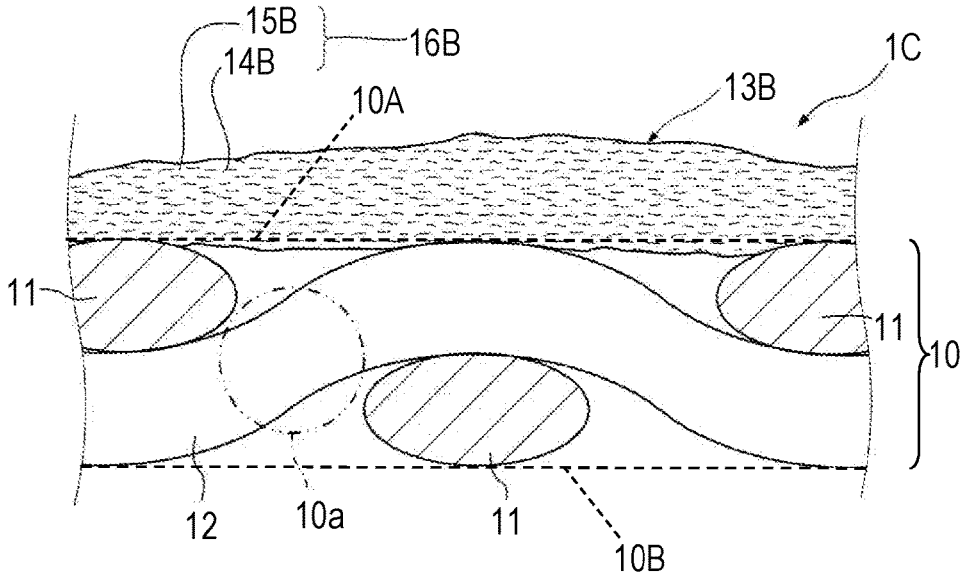
FIG. 7B is an enlarged cross-sectional view of the diaphragm according to the third exemplary embodiment of the present disclosure.

FIG. 7B is an enlarged cross-sectional view of soft dome diaphragm 1C according to the present embodiment. Sealing layer 13B is disposed on first face 10A of woven fabric 10 in which warp threads 11 and weft threads 12 intersect with each other. Sealing layer 13B seals mesh openings 10*a* surrounded by warp threads 11 and weft threads 12. Sealing layer 13B is formed of second composite material 16B which is a mixture of short nanofibers 14B and resin 15B. Second composite material 16B is the same as that of the second exemplary embodiment. In other words, the mixing ratio of short nanofibers 14B with respect to resin 15B is also the same as that of the second exemplary embodiment.

Diaphragm 1C can be manufactured by the following processes. FIG. 7A is an enlarged cross-sectional view of woven fabric 10. Woven fabric 10 is the same as those in the first and second exemplary embodiments.

In the first step, as illustrated in FIG. 7B, second composite material 16B is applied or sprayed onto first face 10A of woven fabric 10, so that second composite material 16B permeates mesh openings 10*a*, and then sealing layer 13B seals mesh openings 10*a*.

Note that part of short nanofibers 14B of second composite material 16B may be effused through mesh openings 10*a* which are in the process of being sealed, but part or all of short nanofibers 14B remains in woven fabric 10 by adjustment of the viscosity of resin 15B of second composite material 16B.

By changing at least part of the component or processing conditions of second composite material 16B, it is possible to cause sealing layer 13B to permeate woven fabric 10 deeper, compared with the second exemplary embodiment. For example, reducing the viscosity of second composite material 16B allows second composite material 16B to permeate woven fabric 10 deeply.

In the second step, woven fabric 10 which has undergone the sealing process is thermally shaped into a dome at 190° C.

The rigidity and the strength of diaphragm 1C are increased by short nanofibers 14B of sealing layer 13B, compared with woven fabric 10. Accordingly, the tweeter which includes diaphragm 1C has extended upper limit frequency characteristics of the loudspeaker, less distortion while maintaining the sound pressure characteristics, and higher sound quality, compared with the tweeter which includes a soft dome diaphragm with no sealing layer 13B.

In the embodiment above, sealing layer 13B is formed before woven fabric 10 is made into the shape of a diaphragm. However, sealing layer 13B may be formed after woven fabric 10 is made into the shape of a diaphragm.

In each of the embodiments above, polyester fibers are used for woven fabric 10. Examples of other fibers which may be used for woven fabric 10 include chemical fibers (such as aramid and liquid crystal polymer) other than polyester fibers, ceramic fibers, carbon fibers, metal fibers, natural fibers (such as cotton and silk) and blended fibers thereof.

Making the average diameter of short nanofibers 14A and 14B in each of the above embodiments, preferably, greater than 0 nm and less than 100 nm, allows the rigidity and the strength of the diaphragms to be further increased, the upper limit frequency characteristics of the loudspeaker can be further extended, and the distortion can be further reduced. More preferably, making the average diameter of short nanofibers 14A and 14B greater than 0 nm and less than 20 nm, allows the rigidity and the strength of the diaphragms to be significantly increased, the upper limit frequency characteristics of the loudspeaker can be further extended, and the distortion can be further reduced. Reduction in average diameter of the short nanofibers can improve the performance of the loudspeaker more significantly. However, since a long time duration and many steps are required for manufacturing, the price of the loudspeaker diaphragm tends to increase. Accordingly, it is important to set the average diameter of the short nanofibers with a good balance between performance demand and price demand of a loudspeaker to be developed.

Figure 8:
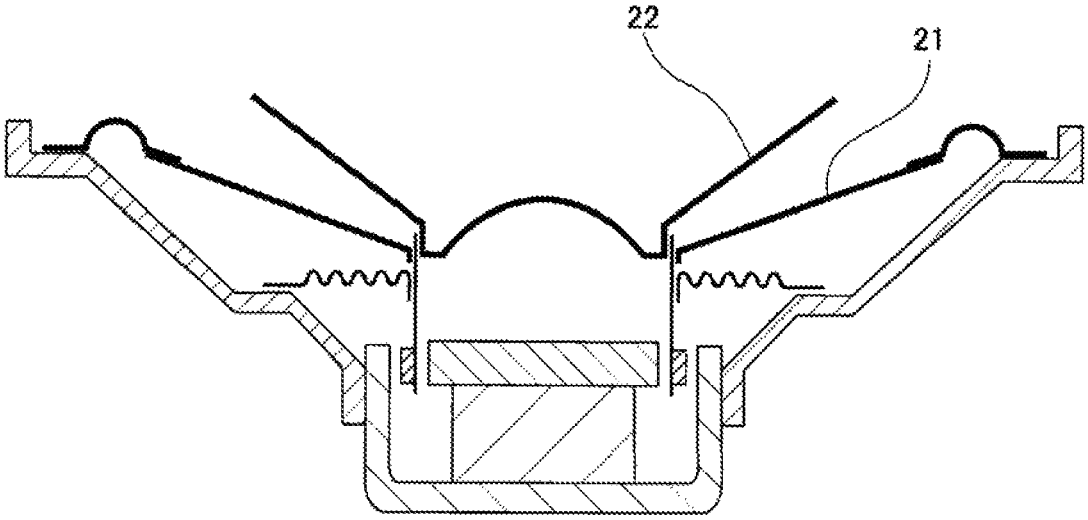
FIG. 8 is a cross-sectional view of a general double cone loudspeaker.

Although the shape of the diaphragm in each of the above embodiments is a dome shape in the tweeter, it may be the cone shape of a cone loudspeaker. Specifically, a diaphragm according to any one of the embodiments of the present disclosure may be used as sub-cone 22 disposed in the central portion of cone loudspeaker diaphragm 21 illustrated in FIG. 8. In this case, when woven fabric 10 is made into the shape of a diaphragm, woven fabric 10 is formed into the shape of a cone.

The present disclosure contributes to an increase in rigidity for enhancing high frequency characteristics and reducing distortion of a loudspeaker.

What is claimed is:

1. A loudspeaker diaphragm comprising:

a woven fabric formed into a shape of a diaphragm, the woven fabric having a first face and a second face on a reverse side of the woven fabric from the first face;

a sealing layer disposed on the first face of the woven fabric, the sealing layer sealing a mesh opening surrounded by warp threads and weft threads of the woven fabric; and a coating layer formed of a first composite material which is a mixture of a plurality of first short nanofibers and a first resin, the coating layer permeating the woven fabric from the second face of the woven fabric to the sealing layer.

2. The loudspeaker diaphragm according to claim 1, wherein the sealing layer is formed of a second composite material which is a mixture of a plurality of second short nanofibers and a second resin.

3. The loudspeaker diaphragm according to claim 2, wherein, in the sealing layer, a weight ratio of the second resin with respect to the plurality of second short nanofibers is at least 1.5 and at most 9.

4. The loudspeaker diaphragm according to claim 1, wherein, in the coating layer, a weight ratio of the first resin with respect to the plurality of first short nanofibers is at least 1.5 and at most 9.

5. The loudspeaker diaphragm according to claim 1, wherein an average diameter of the plurality of first short nanofibers and the plurality of second short nanofibers is greater than 0 nm and less than 1 μm.

6. The loudspeaker diaphragm according to claim 1, wherein an average diameter of the plurality of first short nanofibers and the plurality of second short nanofibers is greater than 0 nm and less than 100 nm.

7. The loudspeaker diaphragm according to claim 1, wherein an average diameter of the plurality of first short nanofibers and the plurality of second short nanofibers is greater than 0 nm and less than 20 nm.

8. A method of manufacturing a loudspeaker diaphragm, the method comprising:

forming a sealing layer on a first face of a woven fabric that is before or after the woven fabric is formed into a shape of a diaphragm, the sealing layer sealing a mesh opening surrounded by warp threads and weft threads of the woven fabric;

when the sealing layer is formed before the woven fabric is formed into the shape of the diaphragm, (i) applying or spraying a first composite material onto a second face of the woven fabric so that the first composite material permeates to the sealing layer;

subsequently forming the woven fabric into the shape of the diaphragm and drying the woven fabric, the first composite material being a mixture of a plurality of first short nanofibers and a first resin, the second face being on a reverse side of the woven fabric from the first face, or (ii) after forming the woven fabric with the sealing layer into the shape of the diaphragm, applying or spraying the first composite material onto the second face of the woven fabric so that the first composite material permeates to the sealing layer and drying the woven fabric, and when the woven fabric has been formed into the shape of the diaphragm, applying or spraying the first composite material onto the second face of the woven fabric so that the first composite material permeates to the sealing layer and drying the woven fabric.

9. The method of manufacturing the loudspeaker diaphragm according to claim 8, wherein the sealing layer is formed by applying or spraying a second composite material onto the first face of the woven fabric, the second composite material being a mixture of a plurality of second short nanofibers and a second resin.

10. A loudspeaker comprising:

a magnetic circuit provided with a magnetic gap;

the loudspeaker diaphragm according to claim 1;

a bobbin having a first end coupled to the loudspeaker diaphragm and a second end disposed in the magnetic gap; and a voice coil wound around the bobbin.

* * * * *